US007347730B2

(12) United States Patent
Kameyama

(10) Patent No.: US 7,347,730 B2
(45) Date of Patent: Mar. 25, 2008

(54) GROMMET

(75) Inventor: Isao Kameyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/436,595

(22) Filed: May 19, 2006

(65) Prior Publication Data

US 2006/0276080 A1 Dec. 7, 2006

(30) Foreign Application Priority Data

Jun. 2, 2005 (JP) ..... P2005-162195

(51) Int. Cl.
*H01R 13/40* (2006.01)

(52) U.S. Cl. ..... 439/587; 439/274; 174/650

(58) Field of Classification Search ..... 439/587, 439/588, 274, 275, 279; 174/135, 151, 650, 174/153 G, 152 R, 152 G; 16/2.1, 2.2; 248/56
See application file for complete search history.

(56) References Cited

U.S. PATENT DOCUMENTS 3,681,739 A * 8/1972 Kornick ..... 439/275
3,982,059 A * 9/1976 Holland et al. ..... 174/73.1
4,241,973 A * 12/1980 Mayer et al. ..... 439/581
5,429,529 A * 7/1995 Hashizawa et al. ..... 439/610
5,662,495 A * 9/1997 Inaba et al. ..... 439/610
5,803,767 A * 9/1998 Matsumoto et al. ..... 439/587
6,033,261 A * 3/2000 Wakata et al. ..... 439/587

FOREIGN PATENT DOCUMENTS

JP 6-11564 Y2 3/1994
JP 2002-270313 A 9/2002

* cited by examiner

*Primary Examiner*—Tho D. Ta
*Assistant Examiner*—Travis Chambers
(74) *Attorney, Agent, or Firm*—Sughrue Mion, PLLC

(57) ABSTRACT

A grommet includes an elastic main body that has a through hole through which a shielded cable is passed. An abutment surface is formed within the elastic main body. An end portion of a braid of the shielded cable, which is disposed at a processed portion of the shielded cable, is bought into abutting contact with or pierce into the abutment surface.

3 Claims, 7 Drawing Sheets

GROMMET

BACKGROUND OF THE INVENTION

This invention relates to a grommet for a shielded cable.

A related camera module, which is an example of structural bodies using a shielded cable, will be described with reference to FIGS. 7 and 8. The camera module 51 includes a camera module body 52, a module receiving case 53, and a shielded cable assembly 54. The camera module 51 is, for example, an on-vehicle one (see, for example, JP-A-2002-270313).

The camera module body 52 includes a CCD camera 56 having a lens 55, and a board 57 on which the CCD camera 56 is mounted. The CCD camera 56 includes a body fixed to one side (or surface) of the board 57 such that the lens 55 projects from the other side (or surface) of the board 57. A circuit of a predetermined pattern is formed on the one side of the board 57, and the body of the CCD camera 56 is electrically connected to this circuit. A connector 58 (through which the transmitting of signals to the exterior, the supply of electric power, etc., are effected) is provided at the circuit. The camera module body 52 is adapted to be fixed to an upper open side of the module receiving case 53 by screws.

The module receiving case 53 has an internal space for receiving the body of the CCD camera 56, etc. A through hole is formed through one side wall of the module receiving case 53, the interior and exterior of the module receiving case 53 communicating with each other through this through hole. Although this through hole is not shown in the drawings, the shielded cable assembly 54 is mounted on the module receiving case 53 through this through hole.

As shown in FIGS. 7 and 8, the shielded cable assembly 54 includes a shielded cable 59, a connector 60, and a module mounting portion 61. The shielded cable 59 includes a plurality of insulated conductors 62, a shielding braid 63 provided around the plurality of insulated conductors 62, and a sheath 64 provided around the braid 63. The shielded cable 59 has been subjected to end processing as shown in the drawings.

With respect to this end processing, the plurality of insulated conductors 62 are led out from the front side of the module mounting portion 61, and the connector 60 is provided at distal ends of the thus led-out insulated conductors 62. The connector 60 includes a connector housing 66, and terminals 65, connected respectively to the distal ends of the insulated conductors 62, are inserted into the connector housing 66, and are fixed thereto.

The module mounting portion 61 includes a mounting member 67, and an O-ring 68. A processed portion of the shielded cable 59 (at which the sheath 64 is removed from the insulated cable 59) is received within the mounting member 67, and this portion is sealed by potting 69.

In the above construction, the shielded cable assembly 54 is mounted on the module receiving case 53 by threading a threaded portion 70, formed on the mounting member 67 of the module mounting portion 61, into the through hole formed in the module receiving case 53. When the shield cable assembly 54 is mounted on the module receiving case 53, the O-ring 68 is compressed between the mounting member 67 and the module receiving case 53 to achieve a waterproof performance. The connector 60 of the shielded cable assembly 54 is connected to the connector 58 of the camera module body 52.

With respect to the waterproof performance, the intrusion of water along the shielded cable 59 is suppressed by the potting 69. Also, the intrusion of water is suppressed by the O-ring 68. Further, thanks to the provision of the potting 69, a residual uncut portion of the braid 63 (The braid includes wires woven obliquely with respect to the axis of the cable, and therefore when the braid is cut, this cut end tends to project.), projecting from a cut end of the sheath 64, will not be exposed to the interior of the module receiving case 53. As a result, the short-circuiting between the braid and the camera module body 52 is prevented.

Incidentally, the module mounting portion 61 of the shielded cable assembly 54 involves considerable material and processing costs, considerable time and labor for its assembling operation, etc., and therefore there has been encountered a problem that the overall cost of this assembly 54 increases. If it is only necessary to cover the processed portion of the shielded cable 59 in order that the residual uncut portion of the braid 63 will not project, the use of a known heat-shrinkable tube 71 as shown in FIG. 9 can be proposed as an alternative measure. In FIG. 9, reference numeral 72 denotes a shielded cable, reference numeral 73 denotes a residual uncut portion of a braid, and reference numeral 74 denotes a connector connected to distal ends of insulated conductors 75.

However, this alternative proposal, using the heat-shrinkable tube 71, is of such a structure that it is difficult to mount a seal member such as the O-ring 68, and therefore there is encountered a problem that a sufficient waterproof seal can not be secured between the shielded cable and the module receiving case. And besides, in the alternative proposal using the heat-shrinkable tube 71, the shielded cable 72 is made stiff by the rigidity of the shrunk tube 71, which results in a problem that the efficiency of a cable-installing operation is lowered.

Other alternative proposal than the heat-shrinkable tube 71 which is inexpensive, and can easily secure a sufficient sealing performance is, for example, a structure as shown FIGS. 10 and 11. This structure will be briefly described below.

In FIGS. 10 and 11, this structure includes a module receiving case 78 comprising an upper case 76 and a lower case 77, a rubber plug 80 mounted in a mounting recess 79 formed in the lower case 77 of the module receiving case 78, and a cable 81 passing through the rubber plug 80 (see, for example, JP-UM-B-6-11564). The rubber plug 80 includes a tube 82 for intimate contact with an outer peripheral surface of the cable 81, a bellows portion 83 extending continuously from this tube 82, and a thickened peripheral wall portion 84 which is continuous with the bellows portion 83, and is mounted in the mounting recess 79.

Here, when thinking about the case of applying a shielded cable assembly with a rubber plug to a camera module, using the above structure for reference, such a structure for example as shown in FIG. 12 can be proposed. In FIG. 12, reference numeral 85 denotes a camera module body, reference numeral 86 denotes a module receiving case, and reference numeral 87 denotes the shielded cable assembly with the rubber plug 88.

The camera module body 85 is received in the module receiving case 86. A connector 90 of the shielded cable assembly 87 is connected to a connector 89 of the camera module body 85 received in the module receiving case 86. In the shielded cable assembly 87, an end portion of a shielded cable 91 is processed, and a plurality of insulated conductors 94 are led out from a region where a sheath 92 and a braid 93 are removed from the shielded cable, and the connector 90 is provided at distal ends of the thus led-out insulated conductors 94. The rubber plug 88 is mounted on the processed portion of the shielded cable 91, and is adapted to be mounted on a mounting portion 95 of the module receiving case 86.

The shielded cable assembly 87, shown in FIG. 12, has the rubber plug 88, and therefore has the following problems. Namely, when an end processing operation is to be applied to the shielded cable 91 which is beforehand passed through the rubber plug 88, this processing operation is effected after the rubber plug 88 is moved to a position where this rubber plug will not interfere with the processing operation, and after this processing operation, the rubber plug 88 is returned to a predetermined position. Therefore, there is encountered a problem that the efficiency of the operation is low.

And besides, since the rubber plug 88 must be moved, the shielded cable 91 need to have an extra length portion 96. Therefore, there is encountered a problem that this structure has an influence on the cost and a receiving space. Furthermore, when the rubber plug 88 is not completely returned to the predetermined position, a residual uncut portion of the braid 93 projects toward the camera module body 85 as shown in FIG. 12. Therefore, there is a problem that the short-circuiting, as well as damage of the insulated conductors 94, can occur.

Incidentally, when the rubber plug 88 is so modified as to cover the residual uncut portion of the braid 93 in order to prevent the projecting of this residual uncut portion, that portion of the rubber plug for intimate contact with the shielded cable 91 is reduced in size in the case of the illustrated structure, and this invites a problem that the sealing performance and a holding force can be adversely affected. There is a further problem that depending on the manner of receiving the extra length portion 96, the processed portion of the shielded cable 91 is pushed out by a restoring force of the bent extra length portion 96, so that the residual uncut portion of the braid 93 projects.

SUMMARY OF THE INVENTION

This invention has been made in view of the above circumstances, and an object of the invention is to provide a grommet for a shielded cable which is capable of enhancing the efficiency of an operation and of preventing the short-circuiting and damage.

In order to achieve the above object, according to the present invention, there is provided a grommet, comprising:

an elastic main body that has a through hole through which a shielded cable is passed, wherein an abutment surface is formed within the main body; and wherein a part of an end portion of the shielded cable is bought into abutting contact with or pierce into the abutment surface.

Preferably, the part of the end portion is an end portion of a braid of the shielded cable that is disposed at a processed portion of the shielded cable.

In the invention having the above features, there is provided the structure in which after the shielded cable is processed, this shielded cable can be suitably passed through the rubber plug. And besides, even if the braid has a residual uncut portion, this residual uncut portion of the braid is brought into abutting contact with or pierces into the abutment surface formed on the main body, and therefore is prevented from projecting to the exterior of the main body.

Preferably, the elastic main body includes an annular projecting portion that has the abutment surface.

In the invention having the above feature, by passing the shielded cable through the elastic main body until the residual uncut portion of the braid is brought into abutting engagement with or pierces into the annular projecting portion or until an end surface of a sheath of the shielded cable is brought into abutting contact with the annular projecting portion, the positioning of the rubber plug relative to the shielded cable can be completed. In the invention, when the annular projecting portion has an inner diameter corresponding to a diameter of a bundle of insulated conductors of the shielded cable at the processed portion thereof, the insulated conductors of the processed portion can be held by the annular projecting portion.

Here, it is preferable that the elastic main body has a first containing portion and a second containing portion that constitute the through hole. The first containing portion is smaller in the cross section than the second containing portion. A cross section of the first containing portion is defined by an inner circumference face of the annular projecting portion.

In the invention, there is achieved an advantage that the efficiency of the operation can be enhanced as compared with the related structures. And besides, there is achieved an advantage that the short-circuiting and damage can be prevented. Especially, there is achieved an advantage that the rubber plug of a better form for the shielded cable can be provided.

BRIEF DESCRIPTION OF THE DRAWINGS

The above objects and advantages of the present invention will become more apparent by describing in detail preferred exemplary embodiments thereof with reference to the accompanying drawings, wherein:

FIG. 1A is a side-elevational view showing a condition in which the shielded cable is passed through the rubber plug, and FIG. 1B is a cross-sectional view of the rubber plug and shielded cable of FIG. 1A;

FIG. 6A is a perspective view of a camera module, showing its appearance, and FIG. 6B is a perspective view of a lower case;

DETAILED DESCRIPTION OF THE PREFERRED EMBODIMENTS

Figure 1A:
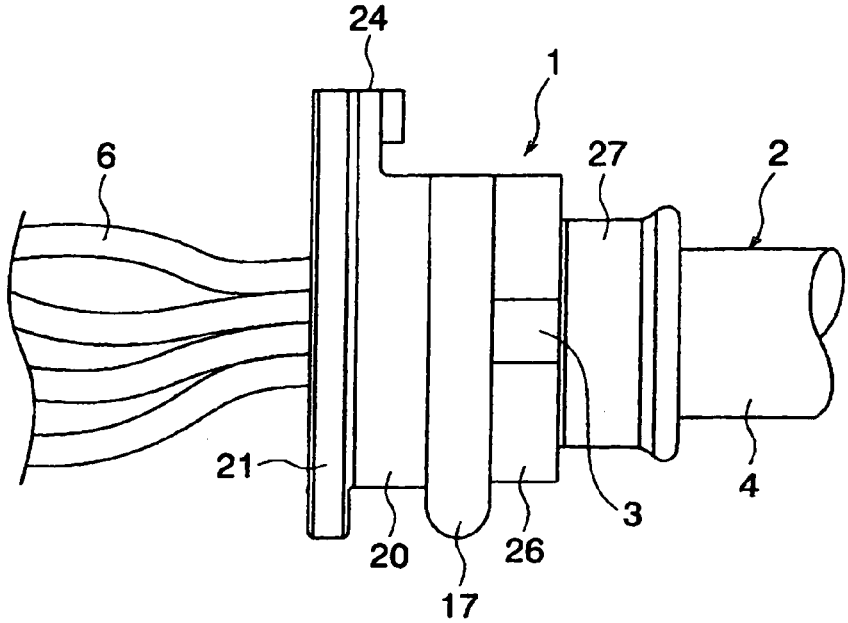
FIGS. 1A and 1B show one preferred embodiment of a rubber plug of the present invention for a shielded cable.
Figure 1B:
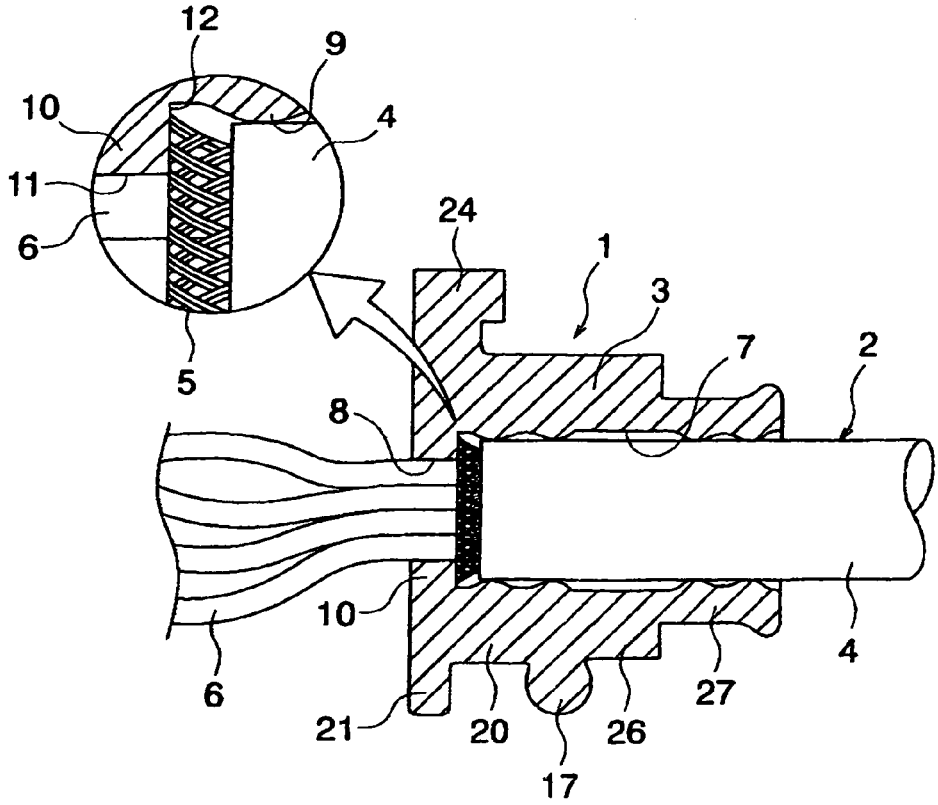
Figure 2:
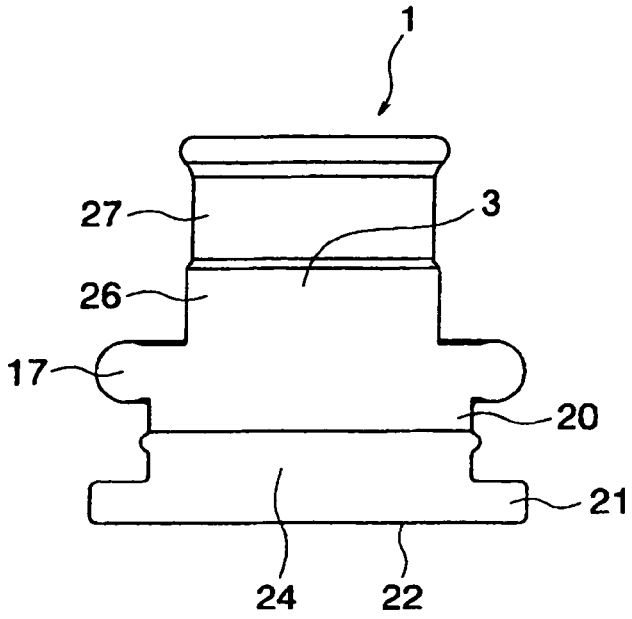
FIG. 2 is a plan view of the rubber plug.
Figure 3:
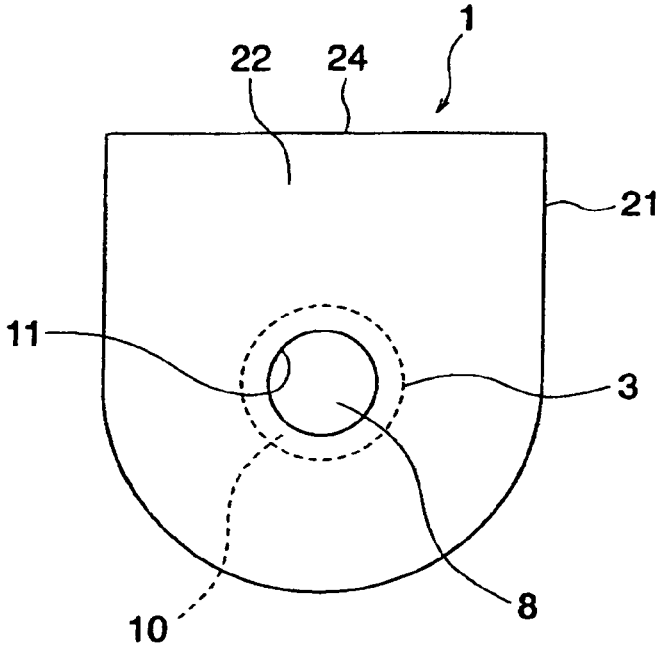
FIG. 3 is a front-elevational view of the rubber plug.
Figure 4:
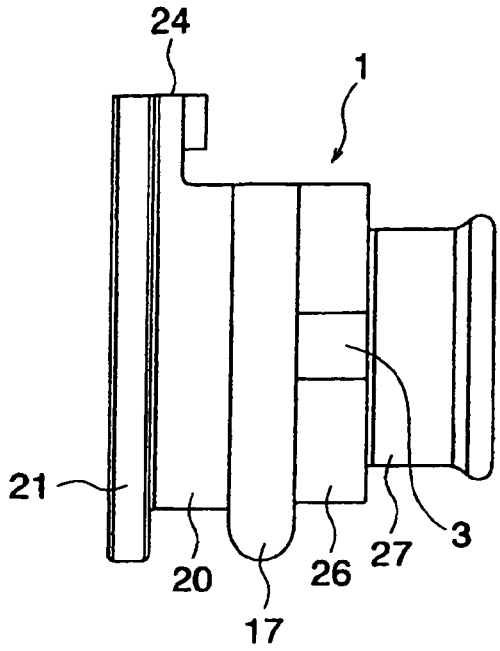
FIG. 4 is a side-elevational view of the rubber plug.
Figure 5:
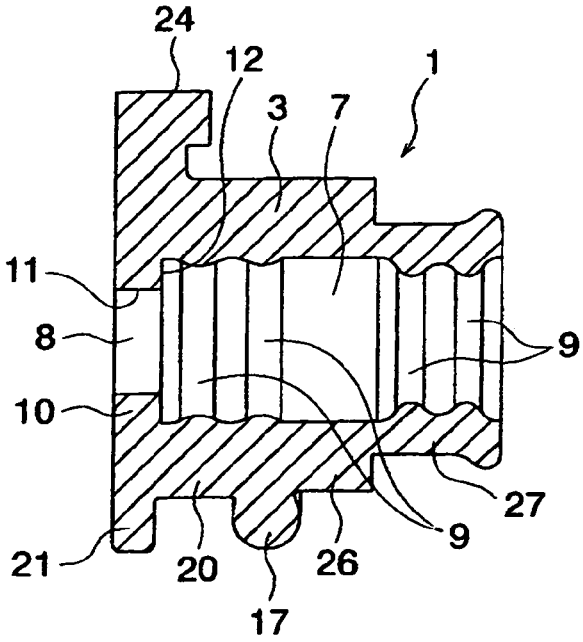
FIG. 5 is a cross-sectional view of the rubber plug.
Figure 6A:
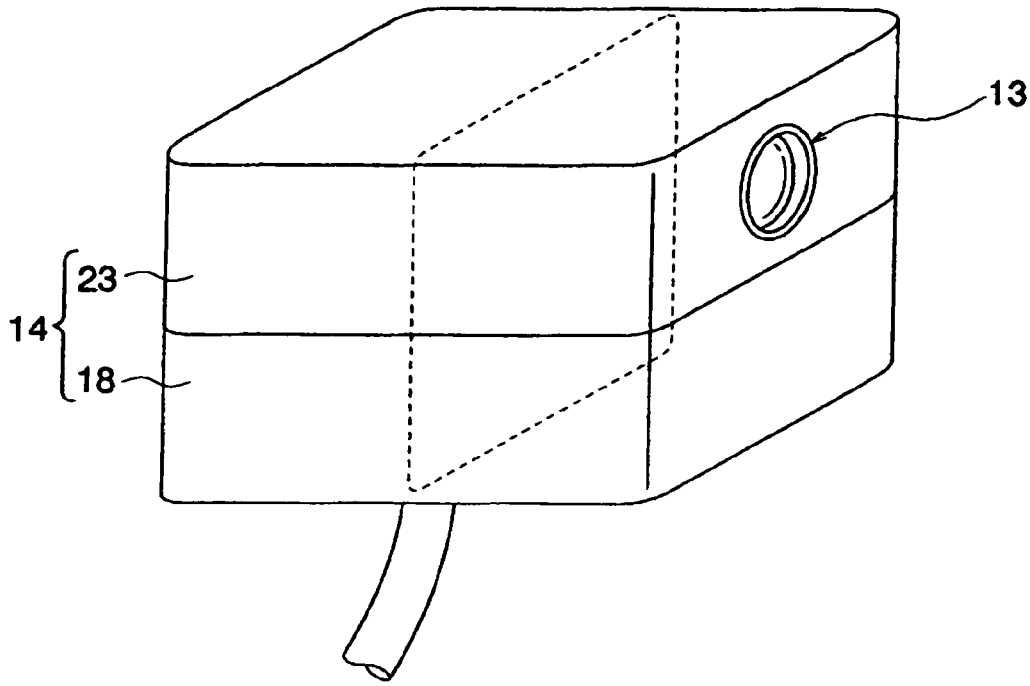
FIGS. 6A and 6B show an example of an object on which the rubber plug is adapted to be mounted.
Figure 6B:
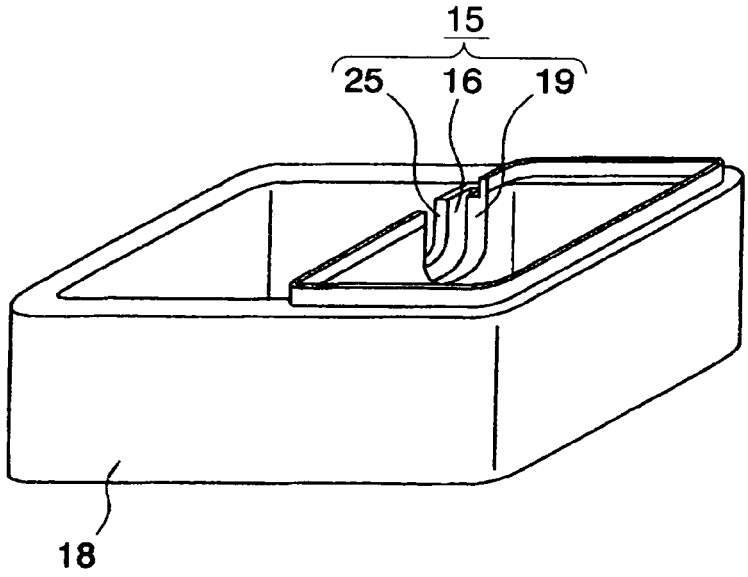
Figure 7:
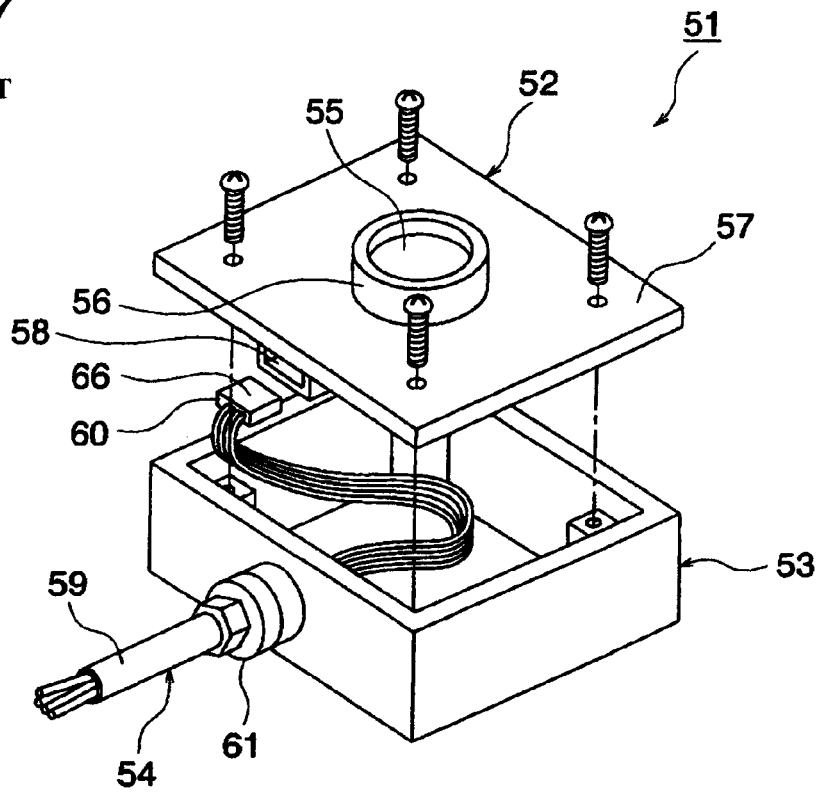
FIG. 7 PRIOR ART
FIG. 7 is an exploded, perspective view of a related camera module as seen from a shielded cable-mounting side.
Figure 8:
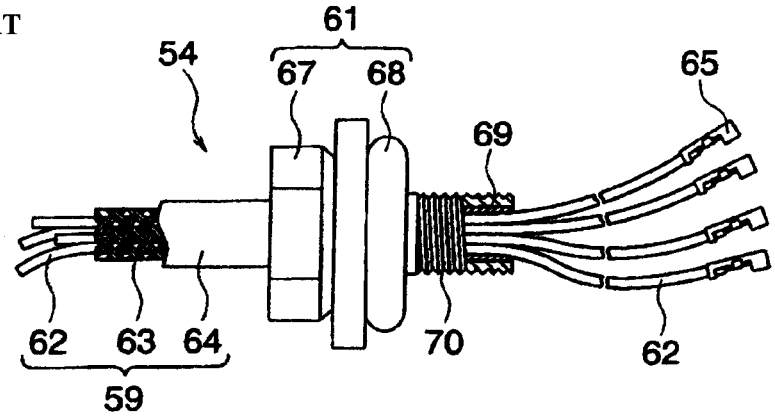
FIG. 8 PRIOR ART
FIG. 8 is a view explanatory of a shielded cable of FIG. 7.
Figure 9:
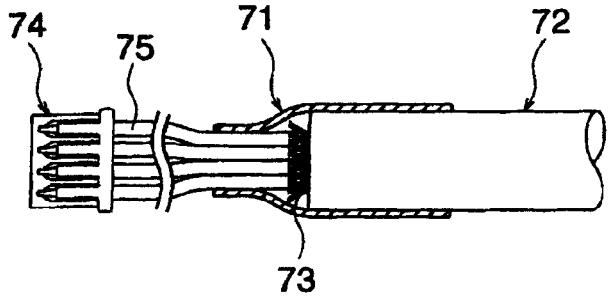
FIG. 9 PRIOR ART
FIG. 9 is an explanatory view showing another example of end processing of a related shielded cable.
Figure 10:
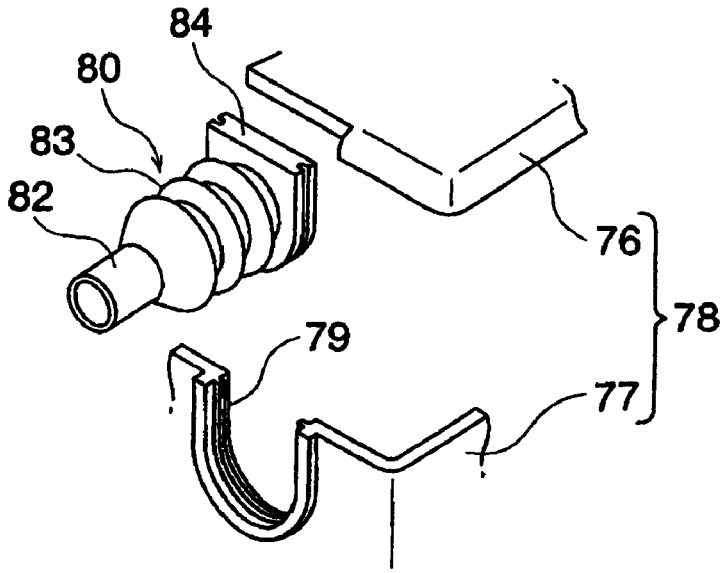
FIG. 10 PRIOR ART
FIG. 10 is an explanatory view showing a further example of end processing of a related shielded cable.
Figure 11:
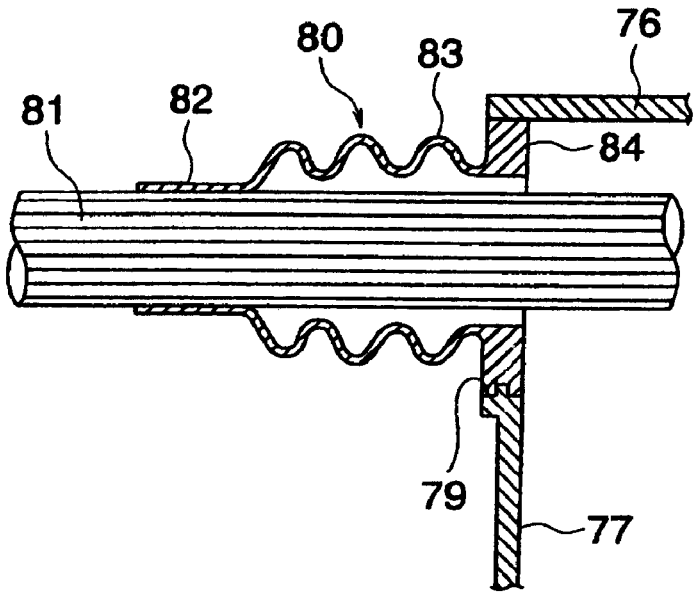
FIG. 11 PRIOR ART
FIG. 11 is a cross-sectional view of the structure of FIG. 10.
Figure 12:
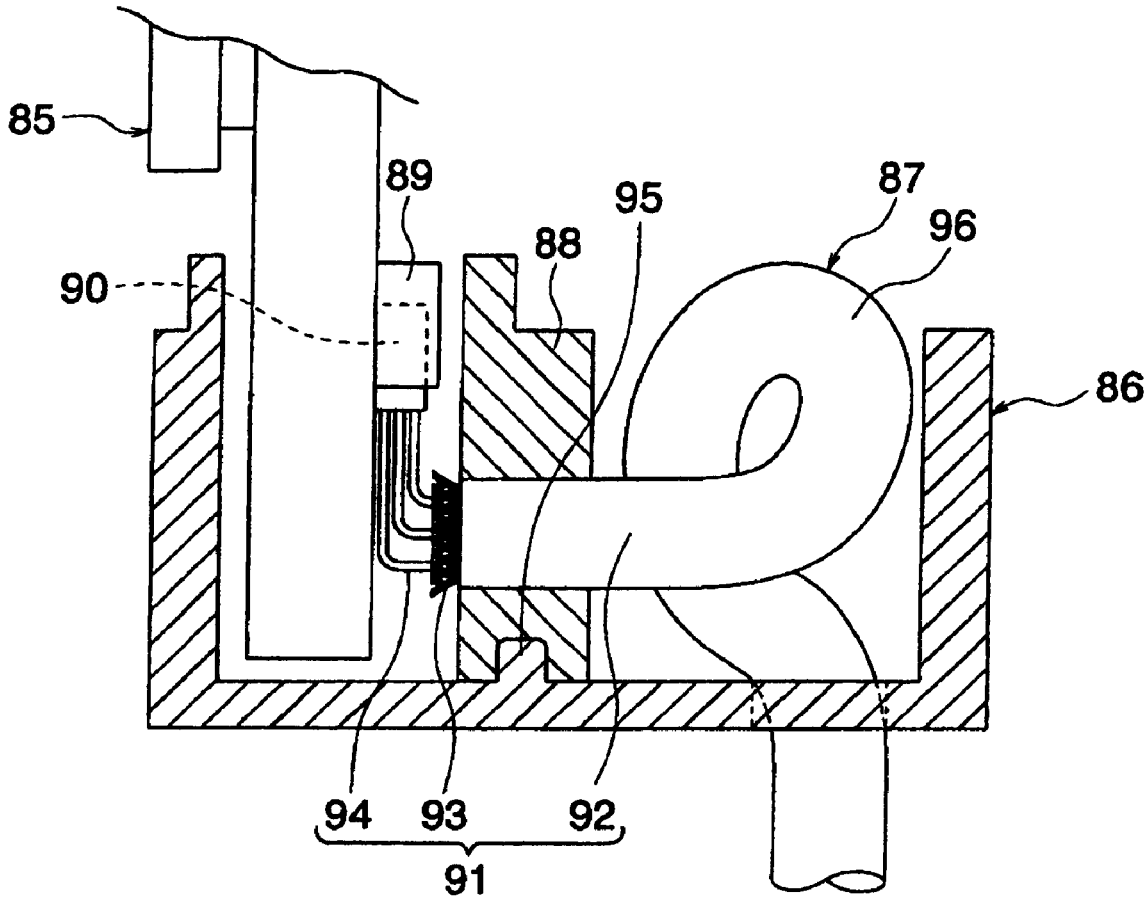
FIG. 12 PRIOR ART
FIG. 12 is an explanatory view showing a still further example of end processing of a related shielded cable.

The present invention will now be described with reference to the drawings. FIGS. 1A and 1B show one preferred embodiment of a rubber plug of the present invention for a shielded cable, and FIG. 1A is a side-elevational view showing a condition in which the shielded cable is passed through the rubber plug, and FIG. 1B is a cross-sectional view of the rubber plug and shielded cable of FIG. 1A. FIGS. 2 to 5 are a plan view, a front-elevational view, a side-elevational view and a cross-sectional view of the rubber plug, respectively, and FIG. 6 is a view showing an example of an object on which the rubber plug is adapted to be mounted.

In FIG. 1, reference numeral 1 denotes the rubber plug of the invention for the shielded cable (hereinafter abbreviated as "rubber plug"). The rubber plug 1 is made of EPDM (ethylene-propylene rubber), silicone or any other suitable material, and has desired elasticity. The rubber plug 1 includes a rubber plug body 3 of a generally tubular shape for the passage of the known shielded cable 2 therethrough. Each of a sheath 4 and a braid 5 is beforehand removed over a predetermined length from the shielded cable 2 which is to be passed through the rubber plug body 3. Namely, end processing has been applied to the shielded cable. A plurality of insulated conductors 6 are led out from the processed portion of the shielded cable 2.

In FIGS. 1 to 5, a first passage space 7 and a second passage space 8 which is continuous with this first passage space 7 are formed in the rubber plug body 3. The first passage space 7 has an inner surface of a generally round shape, and also the second passage space 8 has an inner surface of a generally round shape. The first passage space 7 corresponds in diameter to the sheath 4 of the shielded cable 2. The second passage space 8 corresponds in diameter to a bundle of insulated conductors 6 of the shielded cable 2. The first passage space 7 and the second passage space 8 are arranged to jointly form a continuous inner surface (or bore) extending axially through the rubber plug body 3.

A plurality of annular inner seal portions 9 for intimate contact with the sheath 4 are formed on the inner surface of the first passage space 7. Each inner seal portion 9 has a generally triangular cross-section. In this embodiment, two inner seal portions 9 are formed adjacent to an open end of the first passage space 7, and are arranged at a predetermined interval, while two inner seal portions 9 are formed adjacent to an inner end of the first passage space 7, and are arranged at a predetermined interval. An inner diameter of each of the inner seal portions 9 is smaller than the outer diameter of the sheath 4. The inner seal portions 9 are pressed against the sheath 4 of the shielded cable 2 passed through the inner surface (or bore) of the rubber plug body 3, and are held in intimate contact with the sheath 4. The inner seal portions 9 achieve required waterproof and dust-prevention performances.

An annular projecting portion 10 is formed on the inner surface of the rubber plug body 3. This annular convex portion 10 has a rectangular cross-section, and projects radially inwardly from the inner surface to have a uniform height over an entire periphery thereof. The second passage space 8 is defined by an inner peripheral surface 11 of the annular projecting portion 10. Because of the provision of the annular projecting portion 10, the inner surface of the rubber plug body 3 is formed into a stepped configuration. The bundle of insulated conductors 6 can be held by the inner peripheral surface 11 of the annular projecting portion 10 although the shielded cable is not particularly limited to this arrangement.

The annular projecting portion 10 has a side surface 12 facing the first passage space 7, and an end portion (residual uncut portion) of the braid 5, disposed at the processed portion of the shielded cable 2, can be brought into abutting engagement with or pierce into this surface 12. The surface 12 of the annular projecting portion 10, facing the first passage space 7 and is so disposed as to correspond to the end portion of the braid 5. In case the end portion of the braid 5 does not project from an end surface of the sheath 4 or slightly projects from this end surface, the surface 12 of the annular projecting portion 10, facing the first passage space 7, functions also as an abutment surface (stopper) against which the end surface of the sheath 4 can abut.

The outside of the rubber plug body 3 is formed, for example, into a shape conforming with the shape of a mounting recess 15 formed in a module receiving case 14 of an on-vehicle camera module 13 shown in FIG. 6 although the rubber plug body is not particularly limited to such a shape. This will be more specifically described with reference to FIGS. 1 to 6. An outer seal portion 17 for insertion into a groove 16 of the mounting recess 15 is formed integrally on the outer surface of the rubber plug body 3. The mounting recess 15 is formed in a lower case 18 of the module receiving case 14. The outer seal portion 17 is formed into such a shape that this outer seal portion 17, when inserted into the groove 16, is deformed to achieve required waterproof and dust-prevention performances. In this embodiment, the outer seal portion 17 has a generally round cross-section as is the case with an O-ring.

A slit insertion portion 20 for insertion into a U-shaped slit 19 of the mounting recess 15 and a flange portion 21 continuous with this slit insertion portion 20 are formed on the rubber plug body 3 at the front side of the outer seal portion 17. An outer surface 22 of the flange portion 21, facing away from the slit insertion portion 20, defines a front surface of the rubber plug 1. An engagement portion 24 for engagement with an upper case 23 of the module receiving case 14 is formed at an upper portion of the flange portion 21. A slit insertion portion 26 for insertion into a U-shaped slit 25 of the mounting recess 15 and a cable introduction portion 27 for the shielded cable 2 are formed on the rubber plug body 3 at the rear side of the outer seal portion 17.

The rubber plug 1 of the invention is of such a structure that after the end portion of the shielded cable 2 is processed, this shielded cable 2 is passed through the bore of the rubber plug body 3. Even if the braid 5 has a residual uncut portion which defines the end portion of the braid 5, this residual uncut portion is brought into abutting engagement with or pierces into the surface 12 of the annular projecting portion 10 facing the first passage space 7 when the thus processed shielded cable 2 is passed through the bore of the rubber plug body 3, and as a result the residual uncut portion is prevented from projecting to the exterior of the rubber plug body. Therefore, the rubber plug 1 of the invention achieves advantages that the efficiency of the operation can be enhanced as compared with the related structures and that the short-circuiting and damage can be prevented.

Furthermore, in the rubber plug 1 of the invention, by passing the shielded cable 2 through the bore of the rubber plug body 3 until the residual uncut portion of the braid 5 is brought into abutting engagement with or pierces into the surface 12 of the annular projecting portion 10 facing the first passage space 7 or until the end surface of the sheath 4 is brought into abutting engagement with the surface 12 of the annular projecting portion 10 facing the first passage space 7, the rubber plug 1 can be positioned relative to the shielded cable 2. Therefore, the rubber plug 1 of the invention achieves an advantage that the efficiency of the operation can be enhanced.

In the present invention, various modifications can be made without departing from the subject matter of the invention.

The present invention can be applied not only to the above-mentioned camera module but also to the type of box which requires a dust-prevention or a waterproof performance and in which a shielded cable is installed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The present application is based on Japan Patent Application No. 2005-162195 filed on Jun. 2, 2005, the contents of which are incorporated herein for reference.

What is claimed is:

1. A grommet, comprising:

a non-conductive elastic main body that has a through-hole through which a shielded cable is passed in an insertion direction, said hole being defined by a first portion have a first diameter for receiving the shielded cable and a second portion having a second diameter for receiving insulated conductors of the cable, said second diameter being smaller than said first diameter so as to define an abutment surface at a junction between said first and second portions, said abutment surface facing in a direction opposite the insertion direction, wherein an end portion of a braid of the shielded cable, which is disposed at a processed portion of the shielded cable, is bought into abutting contact with or pierce into the abutment surface to limit insertion of the shielded cable into said through hole.

2. The grommet according to claim 1, wherein the elastic main body includes an annular projecting portion that has the abutment surface.

3. The grommet according to claim 1, wherein the elastic main body is integrally formed with a projection portion which has the abutment surface.

* * * * *